US005440109A

United States Patent [19]

Hering et al.

[11] Patent Number: 5,440,109

[45] Date of Patent: Aug. 8, 1995

[54] AUTOMATIC TOLL TICKETING SYSTEM

[75] Inventors: Bernhard Hering; Karl Wurst, both of Munich; Joachim Seemann, Germering; Peter Wenter, Munich, all of Germany

[73] Assignee: Siemens Aktiengesellschaft, Munich, Germany

[21] Appl. No.: 208,813

[22] Filed: Mar. 11, 1994

[30] Foreign Application Priority Data

Mar. 31, 1993 [DE] Germany ..... 43 10 580.7

[51] Int. Cl.[6] ..... G07B 15/02

[52] U.S. Cl. ..... 235/384; 235/375; 235/382; 235/382.5

[58] Field of Search ..... 235/384, 375, 382, 382.5

[56] References Cited

U.S. PATENT DOCUMENTS 4,908,500 3/1990 Baumberger et al. ..... 235/384

4,958,064 9/1990 Kirkpatrick ..... 235/384

FOREIGN PATENT DOCUMENTS

0413948A1 2/1991 European Pat. Off. .

3833716C2 10/1988 Germany .

*Primary Examiner*—Harold Pitts

*Attorney, Agent, or Firm*—Hill, Steadman & Simpson

[57] ABSTRACT

Vehicles having an on-board device further have a communication device, a vehicle transceiver and an electronic purse in the form of a processor card. Pay stations are arranged at locations along a roadway. The pay stations implement a data exchange with a wireless communication device and debiting a use toll. A vehicle localization device is provided in addition to a communication device at the pay station. The vehicle localization device identifies the position of the vehicle just arriving based on a brief-duration optical signal output by the vehicle transceiver wherein the temporary identifier known from the communication protocol is allocated to the optical signal. The optical signal can be an infrared photoflash that is output on demand by the pay station. The vehicle localization device is an infrared-sensitive video camera that identifies the position based on the optical imaging of this vehicle with computer-controlled evaluation.

14 Claims, 3 Drawing Sheets

AUTOMATIC TOLL TICKETING SYSTEM

BACKGROUND OF THE INVENTION

The present invention generally relates to an automatic toll ticketing system. More specifically, the present invention relates to an automatic toll ticketing system for roadway use by vehicles including on-board equipment having a communication means, a vehicle transceiver and an electronic purse in the form of a processor card, or what is referred to as a "smart card." The automatic toll ticketing system has toll stations arranged at the roadways that implement a data exchange with at least one wireless communications equipment attached to or over the roadway which debit a use fee while preserving the anonymity of the vehicle user.

Toll ticketing systems for roadway use are generally known, particularly systems that are referred to as "closed systems." Toll ticketing systems are increasingly gaining in significance because distance-related roadway use fees are being increasingly demanded by many traffic and environmental engineers. Introduction into countries of such toll ticketing systems that were previously toll-free, however, encounters many difficulties. Only automatic toll ticketing systems that do not impede the flow of traffic and that can be economically erected and operated on the existing road network are considered for high-use roadway networks.

One example of a toll ticketing system is described in German patent 38 33 716 C2 which discloses an automatic roadway toll collecting unit wherein an IS card is employed as a recording medium for collecting tolls based on a bank account of a roadway user. A significant disadvantage of this known automatic collecting unit is that the owner or driver of the vehicle does not remain anonymous. It is also disadvantageous that the collecting of the roadway toll is only possible given stationary vehicles in a toll lane provided for this purpose.

An exact localization of the vehicle which is to pay its roadway toll at the moment is required for toll ticketing in flowing, multi-lane traffic. European Patent Application No. 413 948-A1 discloses a system for automatic data transmission, preferably for the automatic payment of roadway tolls, i.e. wirelessly. To this end, an optical system that images optical absorption areas specifically aligned onto respective lanes is implemented for the data transmission for this purpose. This type of optical system requires a complicated structural fashioning and is not suitable for fast and extensive data traffic because of the comparatively short contact time as a result thereof.

SUMMARY OF THE INVENTION

In an automatic toll ticketing system, it is, therefore, an object of the present invention to enable a reliable, dependable communication between the vehicles and the payment station on multi-lane roads with undiminished vehicle speeds and with changing of lanes by the vehicles, as well as to enable a localization of the communicating vehicle in order to recognize vehicles paying and non-paying vehicles.

In an embodiment, an automatic ticketing system is provided for roadway use by vehicles having an on-board apparatus with a first communication means, a vehicle transceiver, and an electronic purse in the form of a processor card. The roadway has pay stations arranged at the roadway that implement a data exchange with at least one wireless communication means attached at or above the roadway and debit a use toll while preserving the anonymity of a user of the vehicle. The toll ticketing system comprises a vehicle localization means operatively connected at the wireless communication means at the pay station. The vehicle localization means identifies the position of the vehicle. The vehicle communicates by outputting brief-duration optical signals by the vehicle transceiver. A temporary identifier is known from the communication protocol allocated to the optical signal.

It is, therefore, an advantage of the present invention to provide for the exact localization of the vehicle by providing a localization means in addition to communication equipment of the pay station. The localization means identifies the position of the vehicle communicating at the moment based on a brief duration, and an optical signal output by the vehicle communicating at the moment is allocated to this optical signal. The temporary identifier is known from the communication protocol.

Another advantage of the present invention is to provide an additional output signal formed by an infrared photoflash which is output in response to a request on the part of the pay station. A vehicle localization means is thereby expediently formed by an infrared-sensitive video camera that identifies the position of this vehicle based on the optical imaging and correspondingly allocates or correlates the image with a computer-controlled evaluation.

The debiting of the present invention ensues within a defined communication region wherein the successful debiting is acknowledged on a part of the vehicle and is documented on a processor card in order to have particulars about the payment that has been carried out as proof in a check which may potentially be carried out later. It is, therefore, an advantage of the present invention to acknowledge the ensued debiting with the optical signal and/or the infrared photoflash.

It is, therefore, yet another advantage of the present invention to prevent a driver of a vehicle from avoiding any and all communication and, thus any and all payment as well, for example by removing or disabling the vehicle transceiver. A check system independent of the toll ticketing with a suitable vehicle detector is required in order to check whether all detected vehicles also have a paying transceiver. All vehicles that have properly paid their toll are, therefore, known with the vehicle localization means of the present invention.

In order to identify non-payers, either because they have performed manipulations at their debiting means or because they are not equipped with such an apparatus, a vehicle detection means for all vehicles that is coordinated with the vehicle localization means is arranged at the pay station in an embodiment of the present invention. Those vehicles that have not output an acknowledgement signal can thus be found, identified and registered by, for example, photographic acquisition systems.

A video monitoring camera with image recording and image evaluation can be advantageously provided for the vehicle detection means. In a further embodiment of the present invention, the vehicle detection means can be formed by a known traffic radar means which detects the individual vehicles separated according to lane. The non-payers are registered with a film or video camera for still and moving pictures, i.e., with a known photographic acquisition system, whereby the exact allocation or correlation to the vehicle ensues with the traffic radar means.

The data exchange can ensue with the assistance of microwave transmission technology. It is advantageously provided, however, that the data transmission be implemented with the assistance of the infrared light transmission. The infrared light transmission known from a traffic routing and information system (EURO-SCOUT) can thereby be employed.

In the data exchange between the vehicles and the pay station with the assistance of the infrared light transmission, an electronic video camera is arranged at the pay station that preferably localizes the vehicles when the pay station requests that the vehicle transceiver transmit a message as documentation for correct payment. The video camera becomes active while the communication system receives this message in order to identify the position of the paying transceiver. A separate infrared photoflash is thereby not required; this is advantageous for an exact and reliable localization. The active transmission diodes of a vehicle transceiver are thus acquired as a light source with the assistance of the infrared-sensitive camera which is expediently attached immediately next to the infrared station antenna or, respectively, the infrared transmission and reception means.

In other embodiments of the present invention, for suppressing stray light that can be produced by solar reflections, spotlights or blinkers, various measures can be employed. An optical filter which allows only light having the wavelength of the infrared rays employed is attached in the beam path of the camera. The infrared transmission diodes of the vehicle transceiver are arranged in a very specific form that can be easily relocated by image evaluation and can be reliably demarcated with respect to noise sources.

A further advantage of the present invention is matching of exposure time of the electronic camera to the transmission phase of the vehicle transceiver, whereby an individual vehicle is designationally requested to transmit by the pay station within the framework of the transmission protocol. With a further measure, static light sources are highly suppressed by a differentiation technique. To this end, two images are registered during and immediately after the transmission activity and a difference image is formed therefrom. As a result, the disturbing light sources are largely suppressed, and only the transmission diodes are clearly recognizable for the infrared flash or the infrared transmission.

The directional information can be converted into absolute coordinates from the camera image acquired with the infrared-sensitive video camera, whereby information, such as, for example, installation height of the transceiver, can be utilized in addition to the location and the alignment of the camera. The distance to the transceiver can thus be calculated from the visual size of the transceiver in the camera image. A medium installation height of the transceiver is thereby provided for identical vehicle classes. The type of vehicle, i.e. the vehicle class, can be co-transmitted from the vehicle to the pay station in the data exchange. The individual installation position of the transceiver can likewise be transmitted from the vehicle to the pay station.

These and other advantages of the present invention will be described in and will be apparent from the detailed description of the presently preferred embodiments and from the drawings.

DETAILED DESCRIPTION OF THE PRESENTLY PREFERRED EMBODIMENTS

Figure 1:
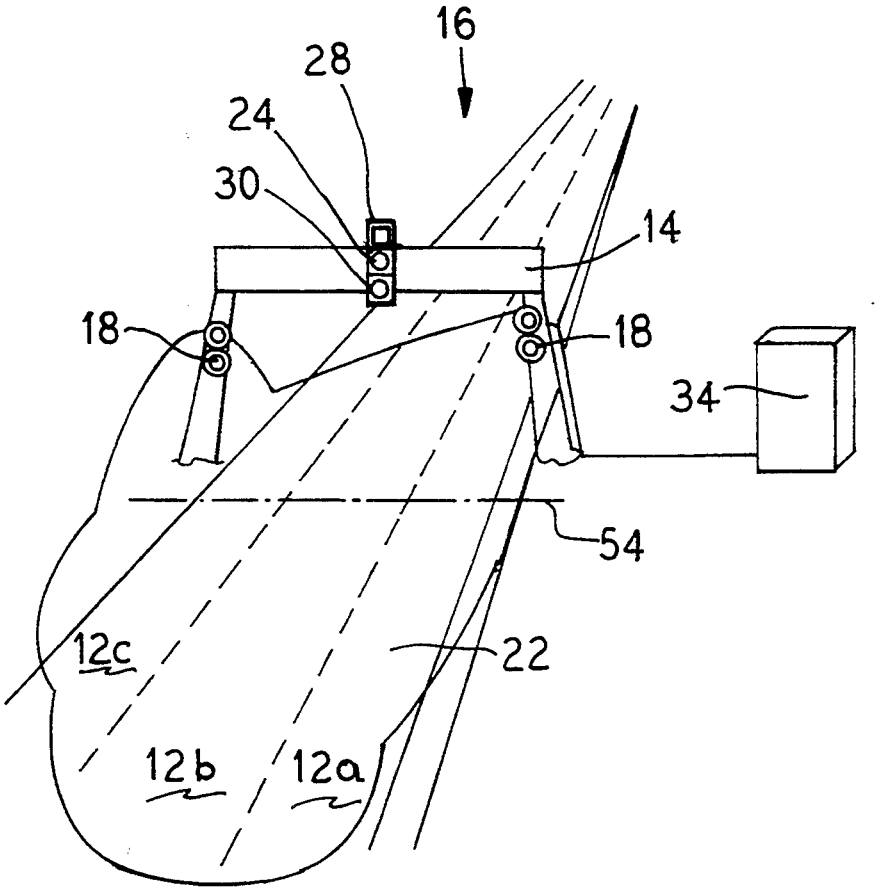
FIG. 1 illustrates a pay station/at a three-lane motor highway.

FIG. 1 schematically illustrates a perspective view of a motor highway 10 having three lanes 12*a*, 12*b*, and 12*c* in one travel direction having a signal bridge 14. A pay station 16 in this embodiment comprises a respective infrared beacon 18 at the left side and at the right side of the signal bridge 14. The infrared beacons 18 are a part of an infrared communication means 20.

Figure 2:
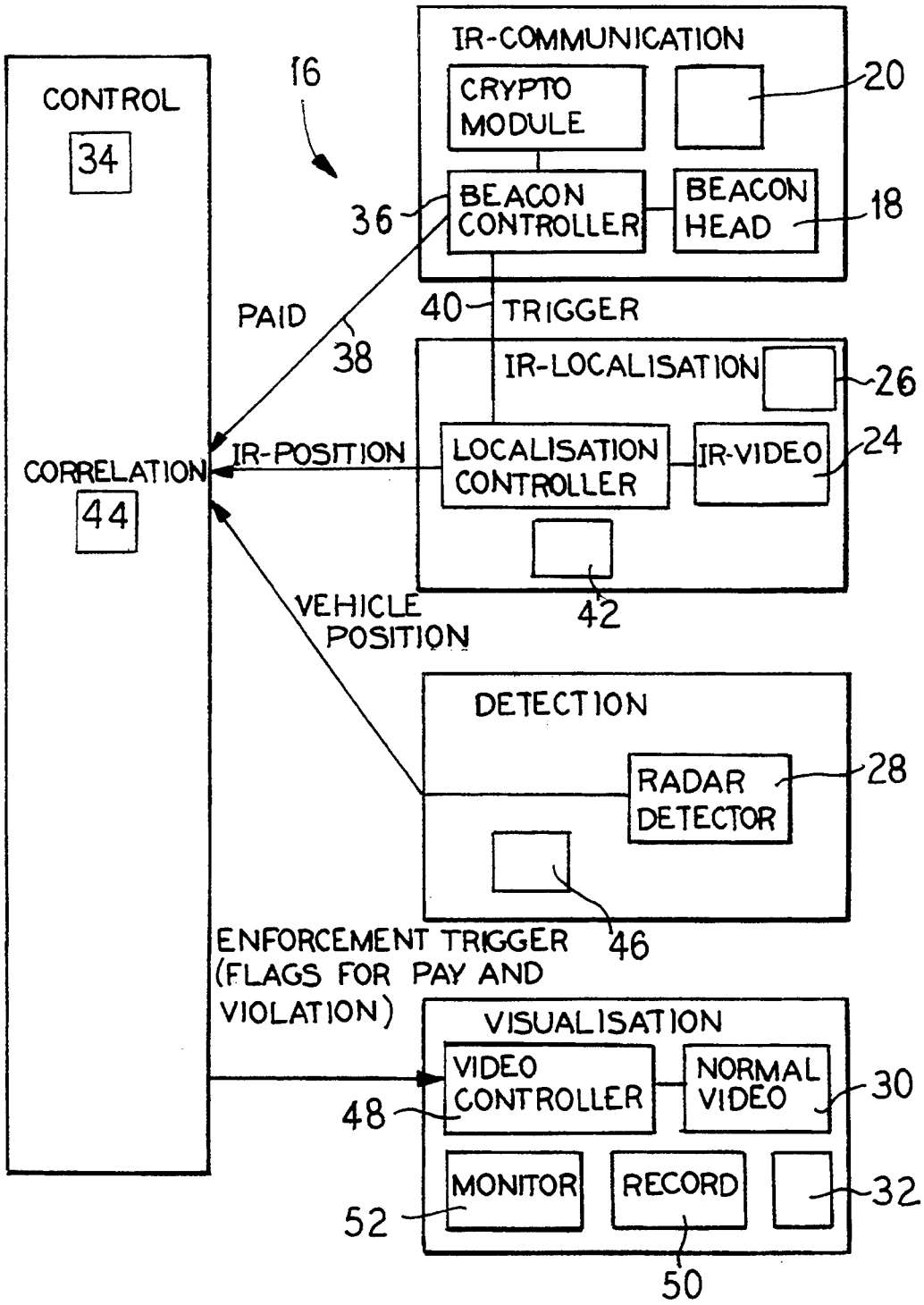
FIG. 2 illustrates a schematic diagram for an automatic toll ticketing and vehicle check.

The two infrared beacons 18 illuminate a specific communication region 22 in a travel direction. An infrared video camera 24, which is part of an infrared light localization means 26, a traffic radar means having a radar detector 28 and a normal video camera 30, which is part of a vehicle identification and registration means 32 are located at the signal bridge 14. These devices are connected to a control and evaluation means 34 where all of the data processing and correlation ensues. The data processing functions and correlations are schematically illustrated in FIG. 2.

The data exchange between the pay station 16 and the individual vehicles is carried out via the infrared beacons 18 with the assistance of the infrared communication means 20. High quality encoding is required (crypto module) in order to be able to administer the credit on a processor card protected against fraud.

The beacon controller 36 of the infrared communication means 20 controls the transaction with the vehicle and the control and evaluation means 34. As already mentioned above, a successfully implemented debiting is confirmed with an acknowledgement signal 38 that is simultaneously employed for the optical signalling from a vehicle transceiver. This is indicated with a trigger pulse 40 which informs the infrared localization means 26 of the acknowledgement.

The infrared localization means 26 or a vehicle localization means 42 acquire the position of the vehicle that has paid and likewise informs a correlation means 44 of the control and evaluation means 34 of the position and payment of the vehicle. In order to identify vehicles that have not paid, all vehicles are monitored with a traffic radar means, i.e. with a vehicle detection means 46 and the appertaining radar detector 28. The positions of the vehicles are communicated to the correlation means 44 of the control and evaluation means 34. In this way, the position of the vehicles that have paid is identified and the non-payers are recognized. The information with respect to payers and non-payers is then available for an exact acquisition and identification.

Registration means 32 is provided for determining the violators with the normal video camera 30, a video controller 48 and a video recorder 50. For visualization, a monitor 52 is provided in the vehicle identification and registration means 32. The control and evaluation means 34 informs the vehicle identification and registration means 32 what vehicles have paid and what vehicles have not paid within a communication limit 54 that may then be identified and registered. The localization detection, identification and registration of vehicles are illustrated in FIG. 3.

Figure 3:
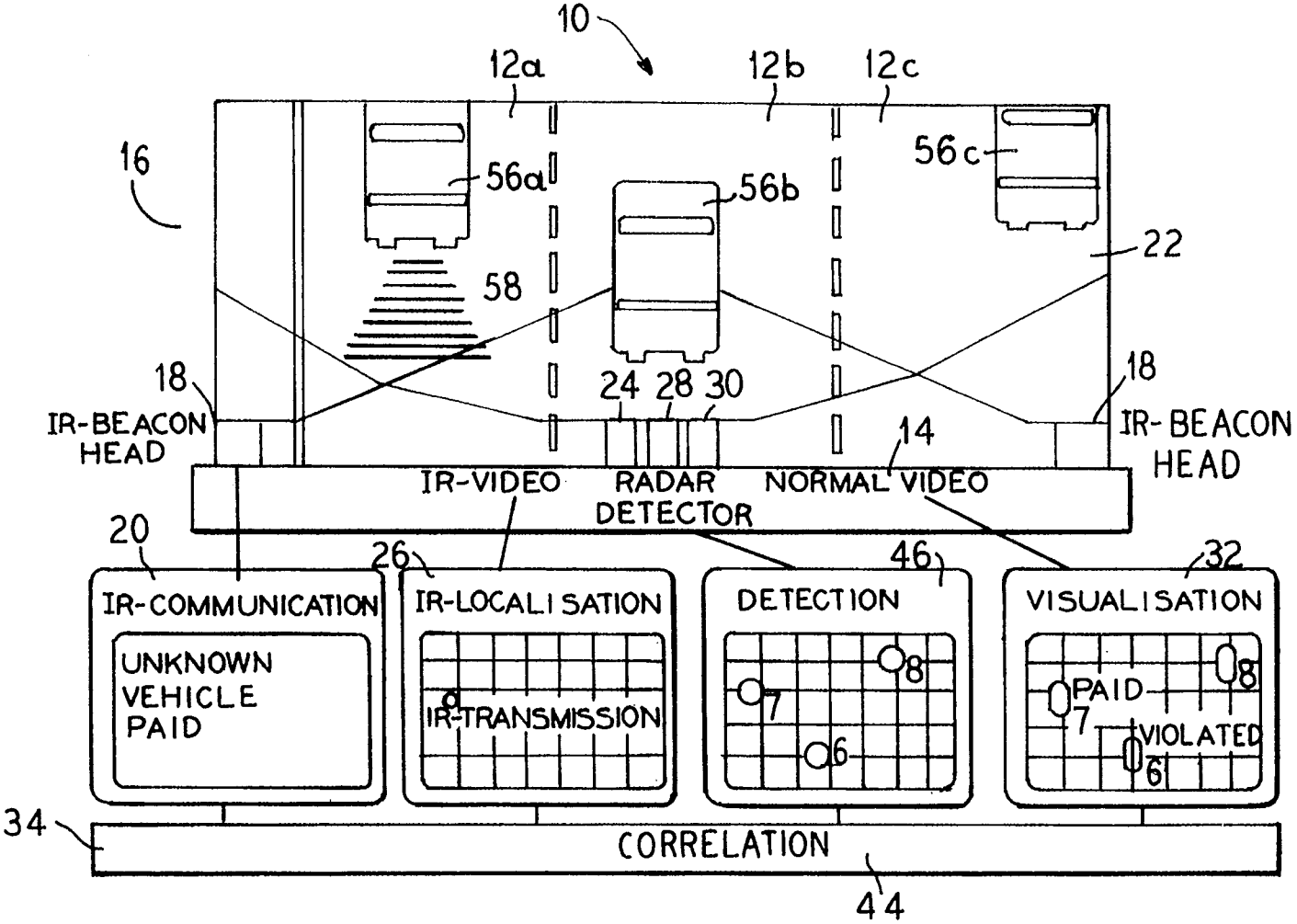
FIG. 3 illustrates a schematic diagram for the vehicle localization and detection as well as vehicle identification and registration at a multi-lane pay station.

Referring now to FIG. 3, a plan view onto the pay station 16 is illustrated having three lanes 12*a*, 12*b*, and 12*c* in one direction of the motor highway. Three vehicles 56*a*, 56*b*, and 56*c* are located on the highway. The infrared beacons 18 to the left and to the right of the motor highway 10 illuminate a specific communication region 22. The infrared video camera 24, the radar detector 28 and the normal video camera 30, which acquire the entire area in front of the pay station 16, are arranged approximately in the middle of the signal bridge 14.

FIG. 3 also illustrates how the infrared communication means 20 recognizes the vehicle which is actually unknown to it as a vehicle that has paid. Based on an optical signal 58 that the vehicle 56*a* outputs, the infrared localization means 26 recognizes the position of the vehicle 56*a*. With the assistance of the traffic radar means 28, the vehicle detection means 46 recognizes the three vehicles 56*a*, 56*b*, and 56*c* that are shown here in the vehicle detection means 46 and are referenced by the numerals 6, 7, and 8. With the assistance of the normal video camera 30, the vehicle identification and registration means 32 visualizes the traffic situation and likewise displays the three vehicles by the designations 6, 7, and 8.

As indicated in FIG. 2, the data of the three or four devices are correlated in the control and evaluation means 34 so that the visual presentation in the vehicle identification and registration means 32 shows the first vehicle 56*a* as having paid with the number 7, shows the second vehicle 56*b*, which has reached the communication limit 54 as a non-payer with the number 6, and shows the third vehicle 56*c*, which is still located in the communication region 54 as not yet having been handled or otherwise recognized and is referenced with the number 8.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An automatic toll ticketing system for a roadway with vehicles thereon, the vehicles having an on-board apparatus with a first communication means, a vehicle transceiver, and an electronic purse in the form of a processor card capable of debiting a use toll while preserving anonymity of a user;

at least one pay station on the roadway, the at least one pay station constructed and arranged to implement a data exchange with at least one wireless communication means attached at the roadway wherein the pay stations debit the use toll while preserving the anonymity of the user; and a vehicle localization means operatively communicating with the at least one wireless communication means at the pay station, said vehicle localization means identifying a position of the vehicle, the vehicle communicating by outputting brief-duration optical signals by the vehicle transceiver without diminishing speed or stopping of the vehicle, a temporary identifier being known from a communication protocol allocated to the optical signal.

2. The automatic toll ticketing system according to claim 1 wherein the optical signal is formed by an infrared photoflash that is output on demand by the at least one pay station and further wherein the vehicle localization means is formed by an infrared-sensitive video camera that identifies the position of the vehicle with computer-controlled evaluation.

3. The automatic toll ticketing system according to claim 1 wherein the debiting is implemented within a specific communication region or communication limit and further wherein the debiting is acknowledged with an acknowledgement signal and is also documented on the processor card.

4. The automatic toll ticketing system according to claim 2 wherein the optical signal is output resulting in debiting following an acknowledgement signal.

5. The automatic toll ticketing system according to claim 4 wherein the pay station further comprises:

a vehicle detection means for all vehicles located in the communication or payment region and is correlated with the vehicle localization means wherein vehicles that output an acknowledgement signal are found, identified and registered with the vehicle localization means and the vehicle detection means.

6. The automatic toll ticketing system according to claim 5 wherein the vehicle detection means comprises a video monitoring camera with image registration and evaluation.

7. The automatic toll ticketing system according to claim 5 wherein the vehicle detection means comprises a traffic radar means which detects the individual vehicles separated according to lanes and additionally comprises an allocated and coordinated vehicle identification and registration means for non-payers.

8. The automatic toll ticketing system according to claim 1 wherein the communication means of the at least one pay station and of the vehicles are operable using microwave transmission.

9. The automatic toll ticketing system according to claim 1 wherein the communication means of the at least one pay station and of the vehicles are operable using infrared transmission means.

10. The automatic toll ticketing system according to claim 9 wherein the infrared light transmission devices known from a traffic routing and an information system are employed for the infrared transmission means.

11. The automatic toll ticketing system according to claim 2 wherein the infrared-sensitive video camera comprises an optical filter which is tuned to the wavelength of the infrared photoflashes.

12. The automatic toll ticketing system according to claim 2 wherein the infrared-sensitive camera is receptive only during transmission of the infrared photoflashes.

13. The automatic toll ticketing system according to claim 2 wherein a plurality of transmission diodes are arranged in a specific form at the vehicle transceiver for the infrared photoflashes.

14. The automatic toll ticketing system according to claim 1 wherein the vehicle localization means records one optical image and a second optical image immediately thereafter during the transmission of the optical signal forming a difference image therefrom.

* * * * *